US007740487B2

(12) United States Patent
Ju

(10) Patent No.: US 7,740,487 B2
(45) Date of Patent: Jun. 22, 2010

(54) CONNECTOR AND MANUFACTURING METHOD THEREOF

(75) Inventor: Ted Ju, Keelung (TW)

(73) Assignee: Lotes Co., Ltd., Keelung City, Taiwan (CN)

( * ) Notice: Subject to any disclaimer, the term of this patent is extended or adjusted under 35 U.S.C. 154(b) by 110 days.

(21) Appl. No.: 12/213,026

(22) Filed: Jun. 13, 2008

(65) Prior Publication Data

US 2009/0017698 A1 Jan. 15, 2009

(30) Foreign Application Priority Data

Jul. 10, 2007 (CN) ..... 2007 1 0029096

(51) Int. Cl.
*H01R 12/00* (2006.01)

(52) U.S. Cl. ..... 439/66

(58) Field of Classification Search ..... 439/66, 439/67; 29/883, 856, 858, 846, 412; 361/760, 361/761

See application file for complete search history.

(56) References Cited

U.S. PATENT DOCUMENTS 5,915,760 A * 6/1999 Kawase et al. ..... 29/883
6,206,681 B1 * 3/2001 Kawase et al. ..... 425/517
6,936,303 B1 * 8/2005 Katsuda et al. ..... 427/117
6,967,556 B2 * 11/2005 Gaschke et al. ..... 336/200
2002/0164392 A1 * 11/2002 Kazmer et al. ..... 425/144
2008/0182436 A1 * 7/2008 Rathburn ..... 439/78

* cited by examiner

*Primary Examiner*—Jean F Duverne
(74) *Attorney, Agent, or Firm*—Rosenberg, Klein & Lee

(57) ABSTRACT

A connector and a method of manufacturing the same one are provided. The connector includes an insulating casing and a plurality of terminals. The insulating casing has a joining surface and a plurality of terminal holes. The terminal holes are arranged to pass through the joining surface in a manner to slant relative to the insulating casing. Each terminal hole has a pair of opposite inner walls. The insulating casing further has a plurality of positioning parts adjacent to at least one of the respective inner walls of the respective terminal holes. The terminals are located within the respective terminal holes. With the use of the positioning parts, when the terminal holes of the insulating casing is formed, the pins do not tend to break and then the slant terminal holes are smoothly formed.

8 Claims, 7 Drawing Sheets

CONNECTOR AND MANUFACTURING METHOD THEREOF

BACKGROUND OF THE INVENTION

1. Field of the Invention

The invention generally relates to a connector and a method of manufacturing the same one, and particularly to a connector which has an insulating casing with slant terminal holes, and a method of manufacturing the same one.

2. Description of the Related Art

Referring to FIG. 1 and FIG. 2, a conventional method of manufacturing a connector forms an insulating casing 40*a* by using a lower mold 10*a* and an upper mold 20*a* matching the lower mold 10*a*. The upper mold 20*a* and the lower mold 10*a* respectively have an upper recess 21*a* and a lower recess 11*a* opposite to the upper recess 21*a*. The lower mold 10*a* has a plurality of pins 13*a*. The upper mold 20*a* has a plurality of slots 23*a* which allow the respective pins 13*a* to insert into along an inserting direction L. The upper recess 21*a* has an upper receiving surface 22*a* tilted relative to the inserting direction L, and the lower recess 11*a* has a lower receiving surface 12*a* tilted relative to the inserting direction L. The lower recess 11*a* further has a plurality of accommodating grooves 14*a*.

The slots 23*a* are formed in the upper receiving surface 22*a*. Each slot 23*a* has a first sidewall 231*a* and a second sidewall 232*a* opposite to the first sidewall 231*a*. The presence of the upper receiving surface 22*a* allows the lower edge of the first sidewall 231*a* to be positioned at a lower level than the lower edge of the second sidewall 232*a*. When the upper mold 20*a* covers the lower mold 10*a*, the upper recess 21*a* and the lower recess 11*a* together define a chamber 30*a* which slants to and intersects with the inserting direction L and is used to form the insulating casing 40*a*. The insulating casing 40*a* has a base 41*a* and the pins 13*a* thereon. The insertion of the pins 13*a* into the slots 23*a* contributes to drive slant terminal holes 42*a* into the mold and to form a plurality of terminals (not shown). The base 41*a* has a plurality of ribs 43*a* extending there from in a manner to correspond to the respective accommodating grooves 14*a* of the lower mold 10*a*.

However, in a case that needs more terminals, the terminals must be made fine and intensively arranged. Therefore, the pins 13*a* which are used to form the terminal holes 42*a* should be made fine accordingly. A lower position of the lower edge of the first sidewall 231*a* than the lower edge of the second sidewall 232*a* makes the pins 13*a* shift when inserted into the slots 23*a*, because the level difference of assembled molds allow the pins 13*a* to contact the lower edges of the first sidewalls 231*a* first and then the lower edges of the second sidewalls is 232*a*. Such action easily breaks or damages the pins 13*a*, and thus fails to smoothly form the terminal holes 42*a*.

Therefore, there is a need of a novel method of manufacturing the connector, which can solve the above prior problems.

SUMMARY OF THE INVENTION

It is an object of the invention to provide a connector and a method of manufacturing the same one, wherein the connector has an insulating casing which is formed in a slant way so that terminal holes can be formed more smoothly without any damage to molds.

In order to achieve the above and other objectives, the connector of the invention includes an insulating casing which has a joining surface and a plurality of terminal holes.

The terminal hole is arranged to pass through the joining surface in a slant way. Each terminal hole has a pair of opposite inner walls. The insulating casing has a plurality of positioning parts and a plurality of terminals. The positioning parts are adjacent to at least one of the respective inner walls of the respective terminal holes. The terminals are arranged within the respective terminal holes in a manner to be tilted relative to the insulating casing.

The method of manufacturing the connector includes the following steps. A first mold and a second mold matching the first mold with at least one chamber there between are provided. The first mold has a plurality of pins and the second mold has a plurality of slots. The pins insert into the respective slots through the chamber along an inserting direction. The chamber tilts to and intersects with the inserting direction. The second mold has a receiving surface which has a low end and a high end. The slots are formed in the receiving surface. Each of the slots has a first sidewall and a second sidewall opposite to the first sidewall. The first sidewall and the second sidewall are respectively close to the low end and the high end of the receiving surface. The receiving surface has a plurality of positioning structures adjacent to at least one of the respective sidewalls of the respective slots. An insulating material is filled within the chamber to enclose the pins so as to form a plurality of terminal holes. An insulating casing is obtained after the insulating material is solidified. The terminal holes are arranged to pass through the insulating casing in a manner to be tilted relative to the insulating casing. The insulating casing further has a plurality of positioning parts corresponding to the positioning structures. The plurality of terminals is located within the respective terminal holes.

The connector offers the following advantages. The method of the invention manufactures the terminal holes which are tilted relative to the insulating casing, while the pins of the mold do not tend to break. In this way, the molding of the terminal holes can be made smooth and the maintenance cost of molds can be saved.

To provide a further understanding of the invention, the following detailed description illustrates embodiments and examples of the invention, this detailed description being provided only for illustration of the invention.

DETAILED DESCRIPTION OF THE EMBODIMENTS

Figure 1:
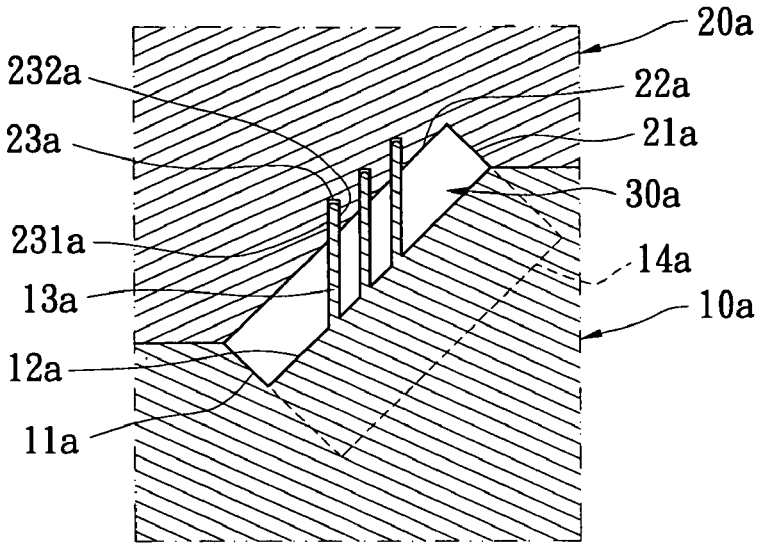
FIG. 1(PRIOR ART)
FIG. 1 is a cross-sectional view of a pair of conventional molds used to manufacture a connector, which are at a closed status.
Figure 2:
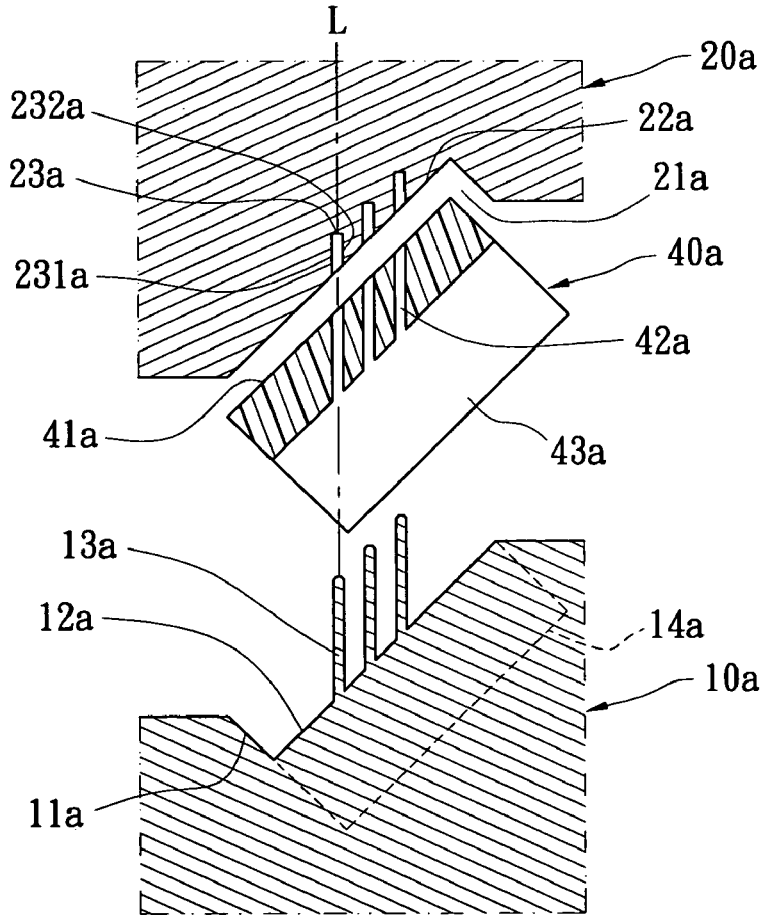
FIG. 2(PRIOR ART)
FIG. 2 is a cross-sectional view of a conventional insulating casing of connector and molds used to manufacture the insulating casing, which are at an opened status.

Wherever possible in the following description, like reference numerals will refer to like elements and parts unless otherwise illustrated.

Figure 3:
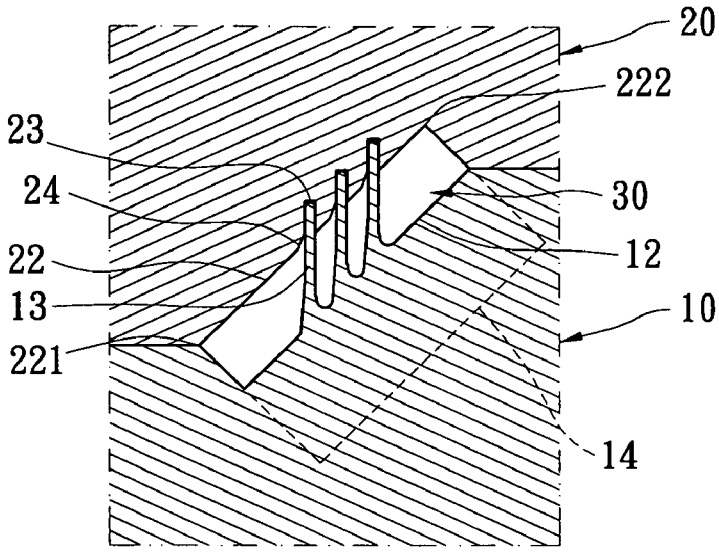
FIG. 3 is a cross-sectional view of a pair of molds at a closed status according to the first embodiment of the invention.
Figure 4:
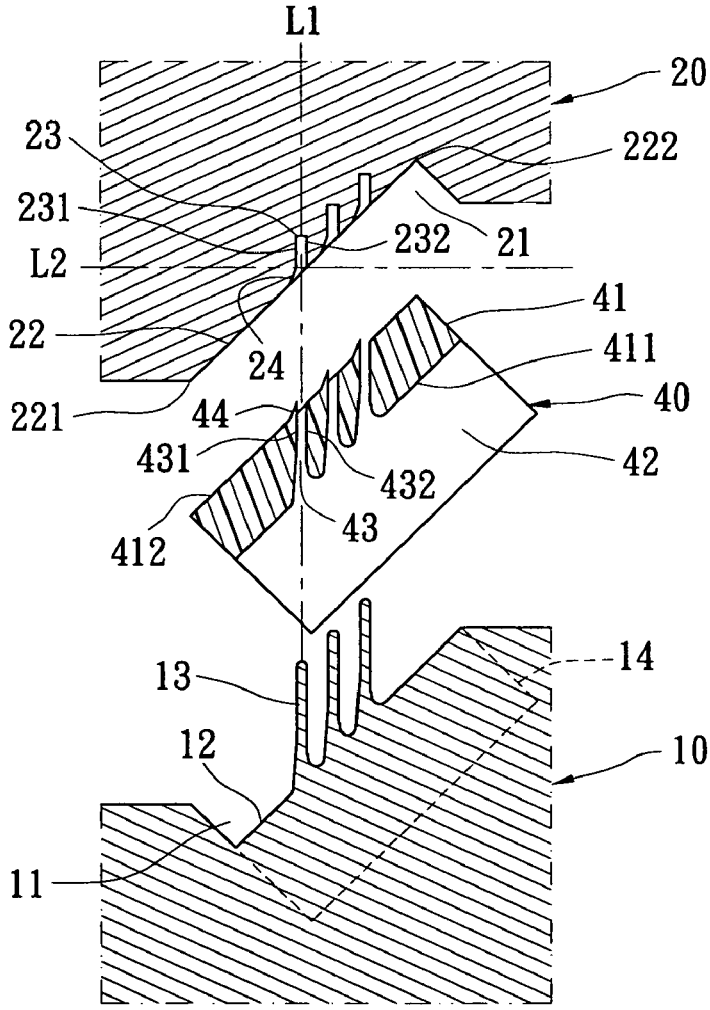
FIG. 4 is a cross-sectional view of an insulating casing and molds at opened status according to the first embodiment of the invention.

FIG. 3 and FIG. 4 respectively depict a method of manufacturing a connector according to the first embodiment of the invention. The method of manufacturing the connector in this embodiment includes the following steps:

(a) A first mold 10 and a second mold 20 which match each other are provided. The first mold 10 has a concave top which forms at least one first recess 11. The first recess 11 has a first concave receiving surface 12 and a plurality of accommodating grooves 14. The first mold 10 further has a plurality of pins 13 thereon;

(b) The second mold 20 has a plurality of slots 23 respectively receiving the corresponding pins 13. The second mold 20 has a concave bottom which forms a second recess 21 corresponding to the first recess 11. The second recess 21 has a second receiving surface 22 parallel to the first receiving surface 12 and tilted relative to an inserting direction L1. The second receiving surface 22 has a low end 221 and a high end 222. The low end 221 is located at a lower position than the high end 222. The slots 23 are located inside the second recess 21 in a manner to correspond to the respective pins 13 to allow the pins 13 to insert into the respective slots 23 through the second receiving surface 22. Each of the slots 23 has a first sidewall 231 and a second sidewall 232 opposite to the first sidewall 231. The first sidewall 231 abut to the low end 221 of the second receiving surface 22, and the second sidewall 232 abut to the high end 222 of the second receiving surface 22. The second receiving surface 22 further has a plurality of positioning structures 24 next to the respective first sidewalls 231 of the slots 23;

In this embodiment, at least one of the positioning structures 24 is a cut corner located at an intersection of the first sidewall 231 and the second receiving surface 22. The horizontal line L2, along the top of the cut corner positioning structure 24 and the lower edge of the second sidewall 232, is vertical to the inserting direction L1. That means the top of the cut corner is at the same horizontal level as the second sidewalls 232 so that even if the pins 13 insert into the slots 23 late, still the smooth insertion of the pins 13 into the slots 23 along the inserting direction L1 can be achieved without being interfered by the lower edges of the first sidewalls 231 and hindered by the lower edges of the second sidewalls 232;

(c) When the first mold 10 covers the second mold 20, as shown in FIG. 3, the first recess 11 and the second recess 21 together form at least one chamber 30 between them in a manner to be tilted relative to the inserting direction L1. The tilting angle of chamber 30 relative to the inserting direction L1 is in the range of 1 to 89 degrees. The pins 13 moves along the direction L1 to pass the, chamber 30 and then go into the respective slots 23;

(d) An insulating material is filled up in the chamber 30 to enclose the pins 13 so as to form a plurality of terminal holes 43;

(e) After the insulating material is solidified, an insulating casing 40 is obtained. The insulating casing 40 has a base 41 and a plurality of ribs 42. The terminal holes 43 pass through the base 41 in a manner to be tilted relative to the insulating casing. The base 41 has a plurality of positioning parts 44 corresponding to the respective positioning structures 24; and (f) A plurality of terminals 50 is disposed within the respective terminal holes 43. Thereby, the connector of the invention is obtained.

In this embodiment, the first mold 10 and the second mold 20 join to each other in a manner to face to face from top to bottom. However, the direction of joining the first mold 10 with the second mold 20 is not particularly limited to a vertical direction as mentioned above, and can be tilted relative to the vertical direction.

Figure 5:
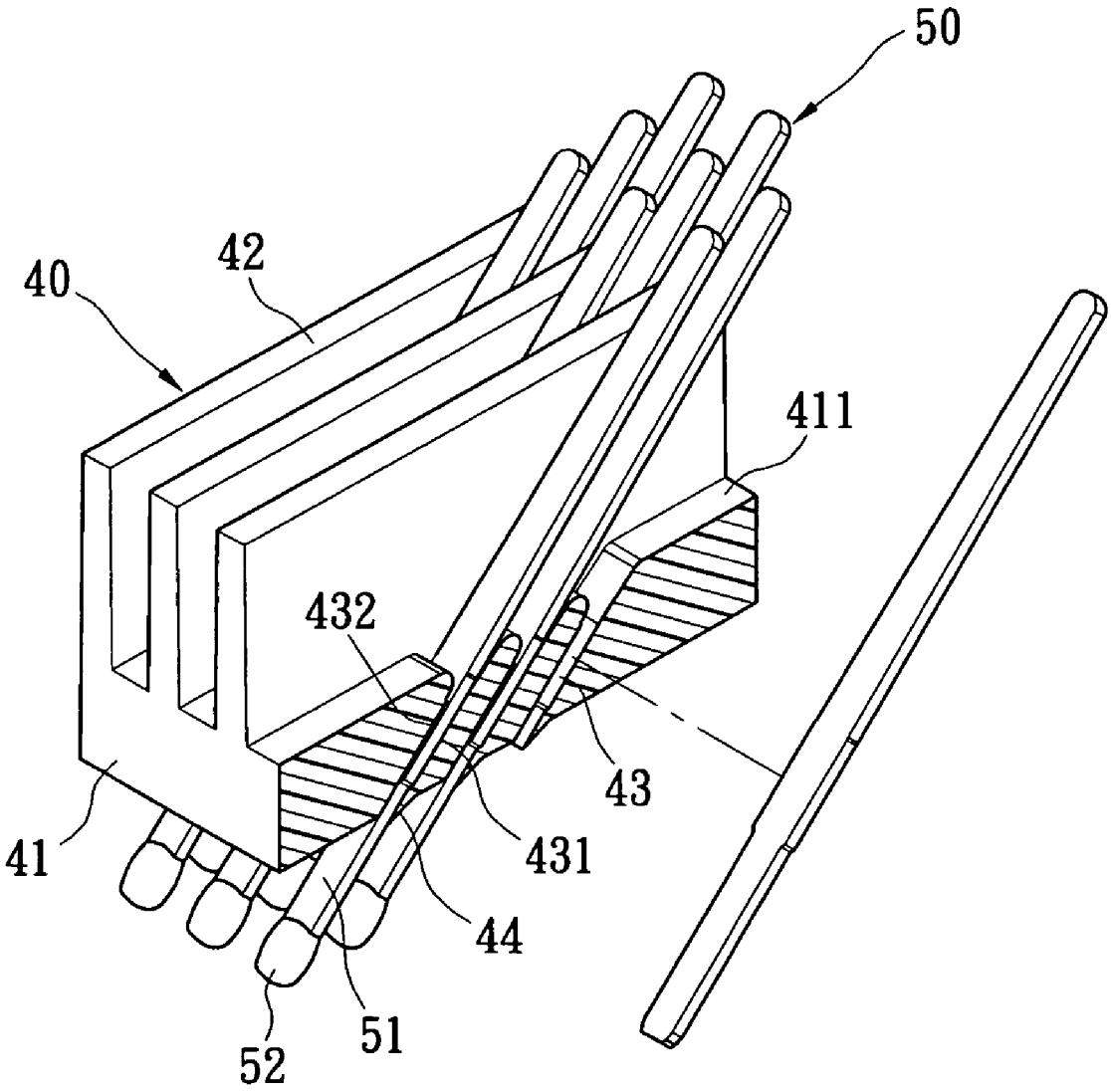
FIG. 5 is a perspective view of a connector according to the first embodiment of the invention.

Referring to FIG. 5, a connector obtained by the method according to the first embodiment of the invention includes an insulating casing 40 and a plurality of terminals 50.

The insulating casing 40 has a base 41 and a plurality of terminal holes 43. The base 41 has a first joining surface 411 and a second joining surface 412, which are respectively formed by the first receiving surface 12 of the first mold 10 and the second receiving surface 22 of the second mold 20, as shown in FIG. 4. A plurality of ribs 42 extending upward from the first joining surface 411 is formed by the accommodating grooves 14 of the first mold 10.

The terminal holes 43 slant to pass through the first joining surface 411 and the second joining surface 412 of the base 41. Each terminal hole 43 includes a first inner wall 431 intersecting the second joining surface 412 at an acute angle, and also includes a second inner wall 432 oppositely parallel to the first inner wall 431 and intersecting the second joining surface 412 at an obtuse angle.

The base 41 has a plurality of positioning parts 44 which outwardly extend from the base and are adjacent to the respective first inner wall 431 of the respective terminal holes 43. In this embodiment, the positioning parts 44 are tapering protruding blocks each of which is located at an intersection of the respective first inner wall 431 and the respective second joining surface 412 of the base 41. Each terminal hole 43 locates on an opening of the first joining surface 411 of the base 41, away from the second joining surface 412, in a manner to gradually expand from inside to outside.

The terminals 50 are made of electrically conductive material in plate form. Each of the terminals 50 has a lead 51 extending out of the insulating casing 40. The lead 51 has a filmy tin enclosure 52 at one end thereof for electrically connecting to an external circuit board (not shown). The terminals 50 are arranged within the respective terminal holes 43, tilted relative to the insulating casing 40.

Figure 6:
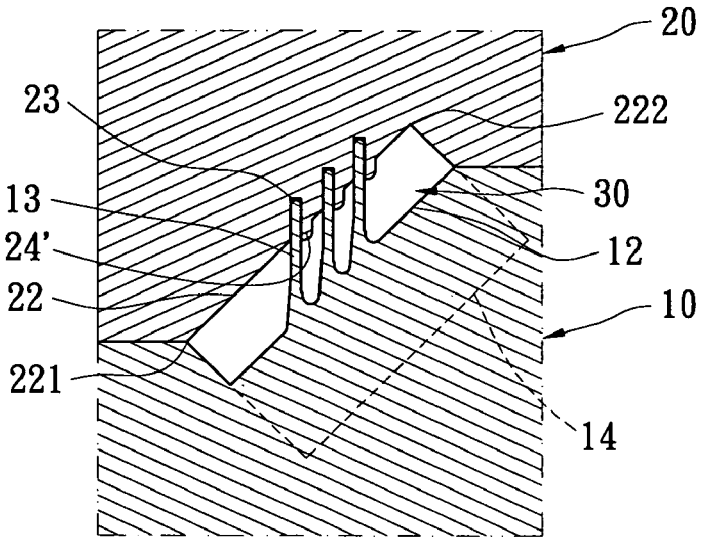
FIG. 6 is a cross-sectional view of a pair of molds at a closed status according to the second embodiment of the invention.
Figure 7:
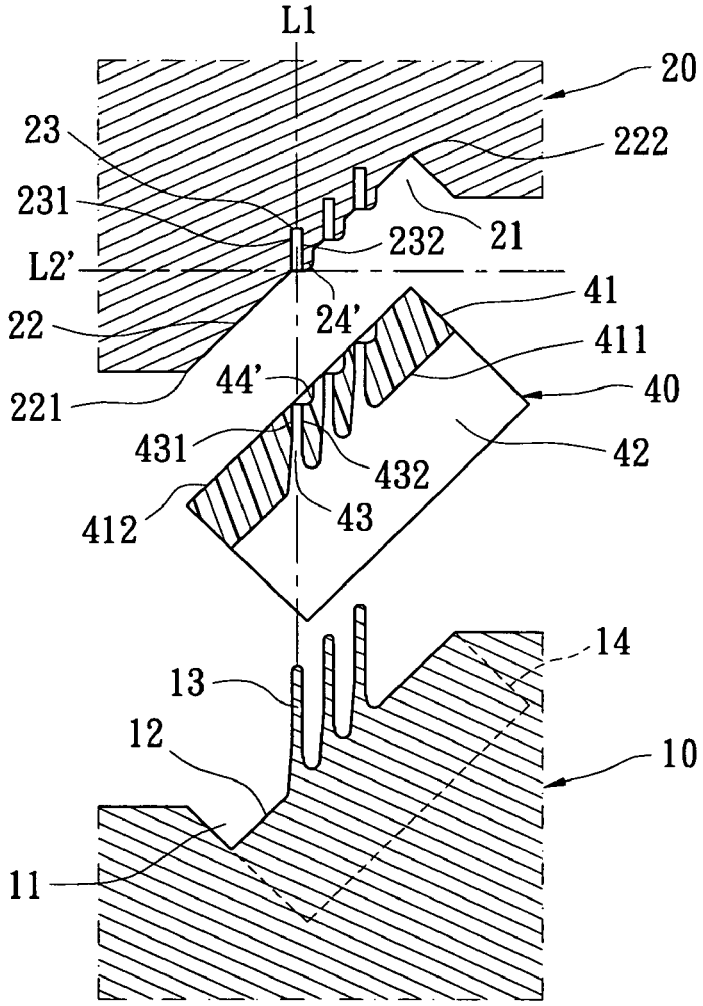
FIG. 7 is a cross-sectional view of an insulating and molds at an opened status according to the second embodiment of the invention

FIG. 6 and FIG. 7 show a connector according to the second embodiment of the invention. The connector in this embodiment is almost the same as the one in the first embodiment, except the following features:

The second receiving surface 22 of the second mold 20 has a plurality of positioning structures 24' adjacent to the respective second sidewalls 232 of the respective slots 23. At least one of the positioning structures 24' is a protruding block which protrudes from the intersection of the second sidewall 232 and the second receiving surface 22. The line L2' along the bottom of the protruding block and the lower edge of the first sidewall 231 is vertical to the inserting direction L1. That means the bottom of the protruding block and the lower edge of the first sidewall 231 are at the same horizontal level so that even if the pins 13 insert into the slots 23 imprecisely, the smooth insertion of the pins 13 into the respective slots 23 along the inserting direction L1 can still be achieved without any interference of the lower edges of the first sidewalls 231 or hindrance by the lower edges of the second sidewalls 232. Thereby, the terminal holes 43 can be smoothly formed within the base 41.

Figure 8:
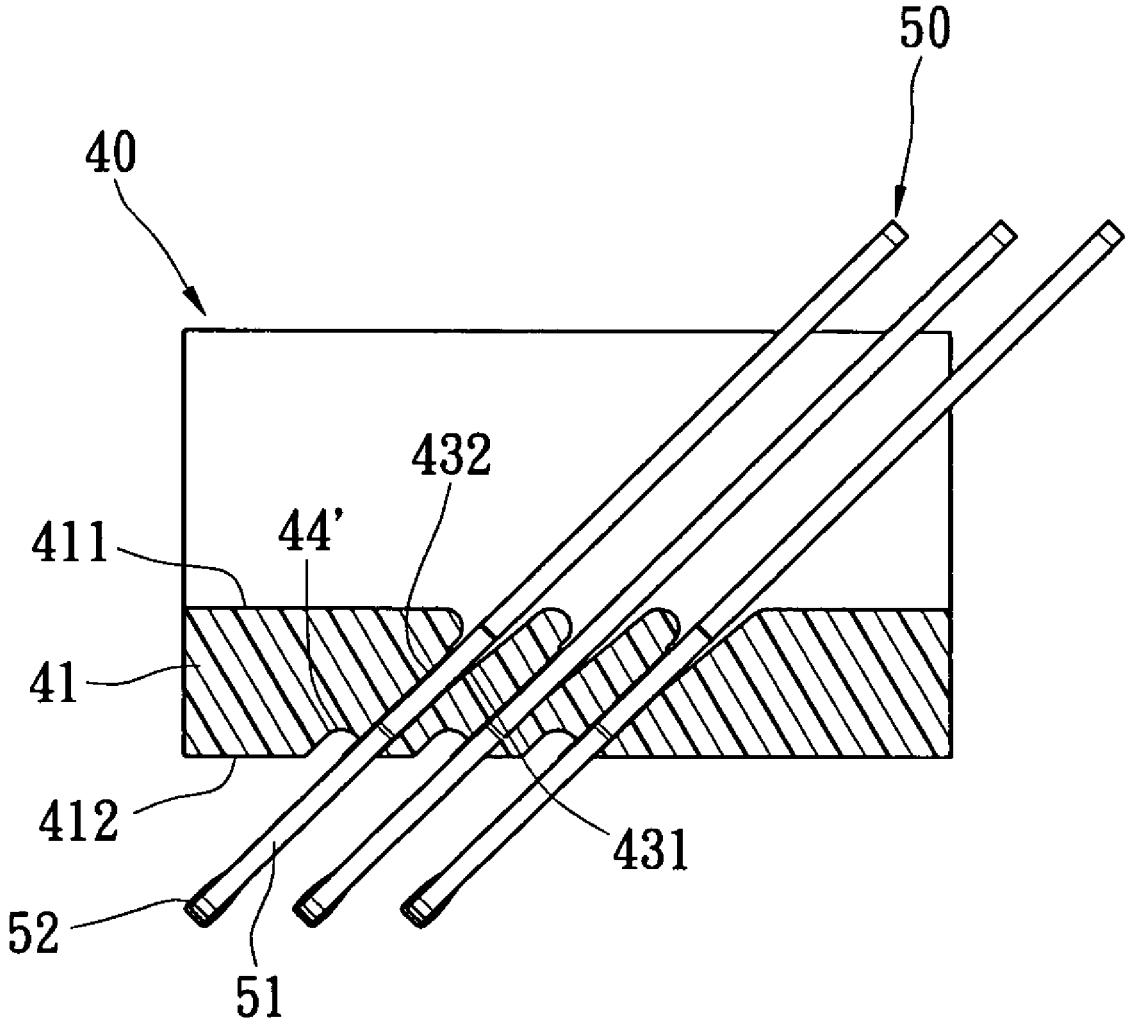
FIG. 8 is a cross-sectional view of a connector according to the second embodiment of the invention.

Referring to FIG. 8, which shows the second embodiment of the invention, the connector in this embodiment is almost the same as the one in the first embodiment, except the following features:

The base 41 has a plurality of positioning parts 44' formed inwardly therein and adjacent to the respective second inner sidewalls 432 of the respective terminal holes 43. At least one of the positioning parts 44' is a recess located at an intersection of the second inner wall 432 and the second joining surface 412 of the base 41.

Figure 9:
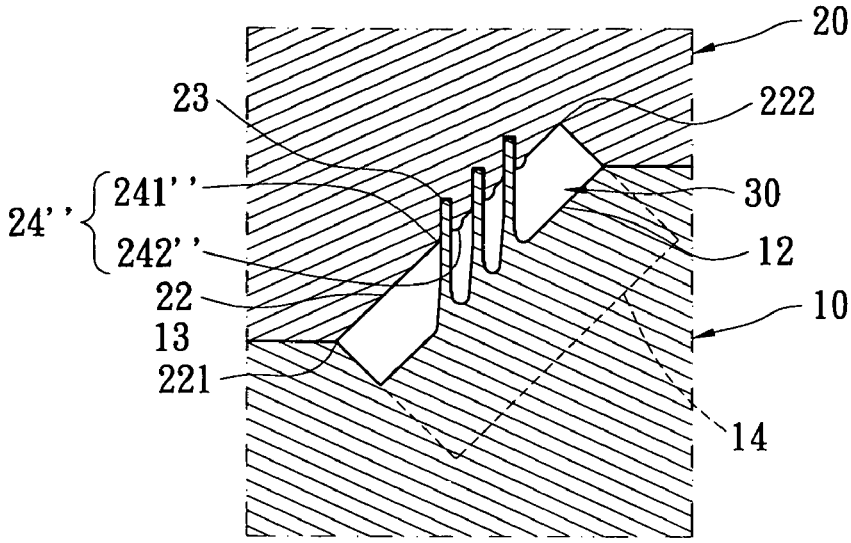
FIG. 9 is a cross-sectional view of a pair of molds at a closed status according to the third embodiment of the invention.
Figure 10:
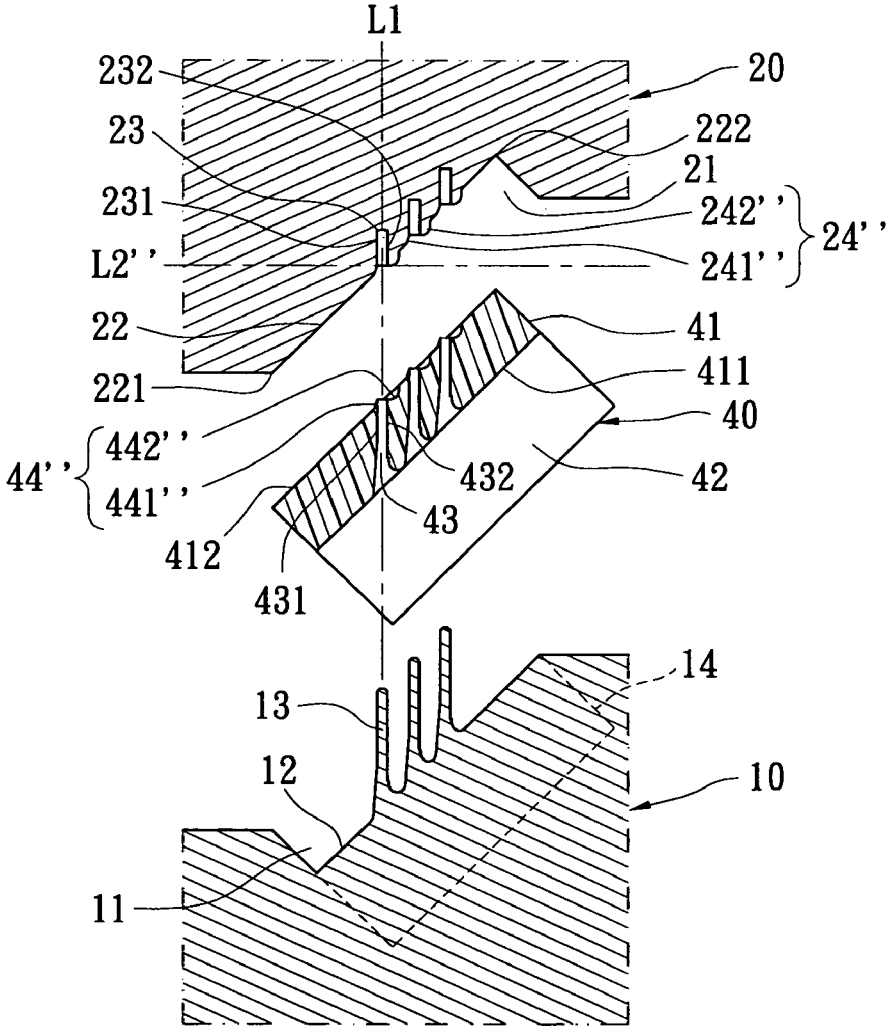
FIG. 10 is a cross-sectional view of an insulating casing and molds according to the third embodiment of the invention.

FIG. 9 and FIG. 10 show a connector according to the third embodiment of the invention. In this embodiment, the connector is almost the same as the one in the first embodiment, except the following features.

The second receiving surface 22 of the second mold 20 has a plurality of positioning structures 24" adjacent to the respective first sidewalls 231 and the respective second sidewalls 23 of the respective slots 23. Each positioning structure 24" includes a cut corner 241" and a protruding block 242". The cut corner 241" locates at an intersection of the first sidewall 231 and the second receiving surface 22. The protruding block 242" locates at an intersection of the second sidewall 232 and the second receiving surface 22. The line L2" along the top of the cut corner 241" and the bottom of the protruding block 242" is vertical to the inserting direction L1. That means the top of the cut corner 241" is at the same horizontal level as the bottom of the protruding block 242" so that the pins 13 can smoothly insert into the respective slots 23 along the inserting direction L1.

Figure 11:
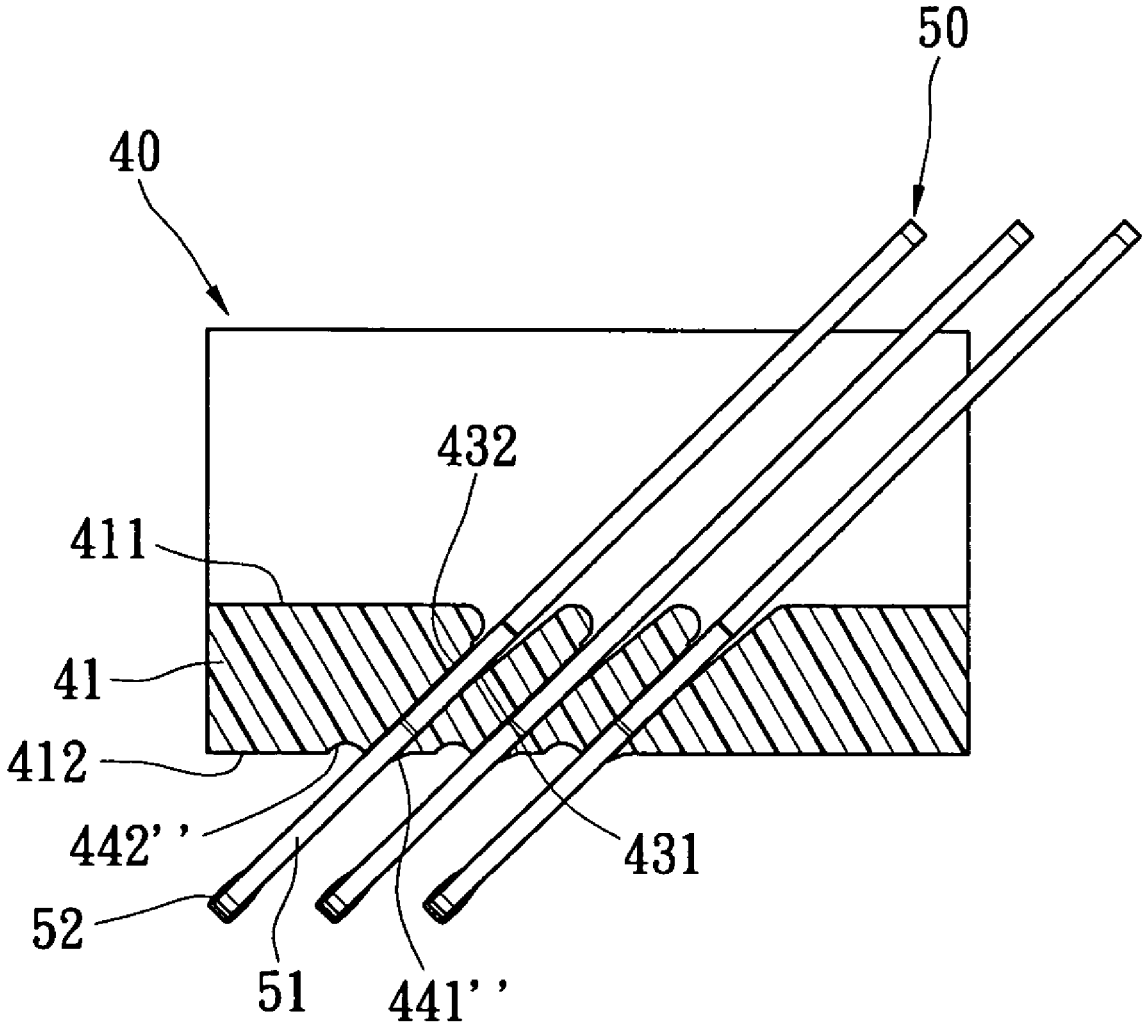
FIG. 11 is a cross-sectional view of a connector according to the third embodiment of the invention.

FIG. 11 shows a connector according to the third embodiment of the invention. The connector in this embodiment is almost the same as the one in the first embodiment, except the following features:

The base 41 has a plurality of positioning parts 44" adjacent to the respective inner walls 431, 432 of the respective terminal holes 43, as shown in FIG. 10 also. The positioning part 44" include a tapered protruding block 441" and a concave recess 442". The tapered protruding block 441" locates at an intersection of the first inner wall 431 and the second joining surface 412. The concave recess 442" locates at an intersection of the second inner wall 432 and the second joining surface 412.

In the light of the foregoing, the positioning structures of the mold corresponding to the slots allow the smooth insertion of the pins into the respective terminal holes and prevent any breakage of the pins within the terminal holes. Therefore, the prior shortages occurring in the conventional molds, for example the pins shift their positions or break due to contacting any low end of any sidewall when inserting into the terminal holes, can be avoided. Furthermore, the molds offer elongated service lives, with saved maintenance cost.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A method of manufacturing a connector, comprising:

providing a first mold and a second mold matching the first mold, the first mold and the second mold together forming at least one chamber there between, the first mold having a plurality of pins, the second mold having a plurality of slots which allow the respective pins to insert into through the chamber along an inserting direction, the chamber being tilted relative to the inserting direction, the second mold having a receiving surface which has a low end and a high end, the slots penetrating through the receiving surface, each of the slots having a first sidewall and a second sidewall opposite to the first sidewall, the first and second sidewalls respectively being close to the low end and the high end, the receiving surface having a plurality of positioning structures adjacent to at least one of the respective sidewalls of the respective slots;

filling up the chamber with an insulating material to allow the insulating material to enclose the pins so as to form a plurality of terminal holes;

obtaining an insulating casing after the insulating material is solidified, wherein the terminal holes are arranged to pass through the insulating casing in a manner to be tilted to the insulating casing, the insulating casing further having a plurality of positioning parts at locations corresponding to the respective positioning structures; and arranging the terminals within the respective terminal holes.

2. The method as claimed in claim 1, wherein at least one of the positioning structures is a cut corner which locates at an intersection of the first sidewall and the receiving surface.

3. The method as claimed in claim 2, wherein a line drawn along the top of the cut corner and the lower edge of the second sidewall is vertical to the inserting direction.

4. The method as claimed in claim 1, wherein at least one of the positioning structures is a protruding block locating at an intersection of the second sidewall and the receiving surface.

5. The method as claimed in claim 4, wherein a line drawn along the bottom of the protruding block and the lower edge of the first sidewall is vertical to the inserting direction.

6. The method as claimed in claim 1, wherein at least one of the positioning structures includes a cut corner and a protruding block which respectively locate at the intersection of the first sidewall and the receiving surface and the intersection of second sidewall and the receiving surface.

7. The method as claimed in claim 6, wherein a line drawn along a top of the cut corner and the bottom of the protruding block is vertical to the inserting direction.

8. The method as claimed in claim 1, wherein the tilted angle of the chamber relative to the inserting direction L1 is in the range of 1 to 89 degrees.

* * * * *